US006854507B2

(12) United States Patent
Pleschiutschnigg et al.

(10) Patent No.: US 6,854,507 B2
(45) Date of Patent: Feb. 15, 2005

(54) METHOD AND SYSTEM FOR OPERATING A HIGH-SPEED CONTINUOUS CASTING PLANT

(75) Inventors: Fritz-Peter Pleschiutschnigg, Duisburg (DE); Stephan Feldhaus, Düsseldorf (DE); Lothar Parschat, Ratingen (DE); Michael Vonderbank, Xanten (DE); Thomas Ulke, Recklinghausen (DE); Robert Victor Kowalewski, Cwambran (DE); Rolf-Peter Heidemann, Olbernhau (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/860,866

(22) Filed: Jun. 4, 2004

(65) Prior Publication Data

US 2004/0244941 A1 Dec. 9, 2004

Related U.S. Application Data

(62) Division of application No. 10/009,153, filed as application No. PCT/EP00/05216 on Jun. 7, 2000, now Pat. No. 6,793,006.

(30) Foreign Application Priority Data

Jun. 7, 1999 (DE) ..... 199 25 713

(51) Int. Cl.[7] ..... B22D 11/16

(52) U.S. Cl. ..... 164/413; 164/414; 164/155.5; 164/155.6; 164/154.4; 164/154.7

(58) Field of Search ..... 164/413, 414, 164/155.5, 155.6, 154.4, 154.7, 453, 454, 455

(56) References Cited

U.S. PATENT DOCUMENTS 6,793,006 B1 * 9/2004 Pleschiutschnigg et al. 164/453

* cited by examiner

*Primary Examiner*—Kiley S. Stoner
*Assistant Examiner*—I.-H. Lin
(74) *Attorney, Agent, or Firm*—Friedrich Kueffner

(57) ABSTRACT

A system provided in a high-speed continuous casting plant for casting a metallic strand for automatically operating the high-speed continuous casting plant. In the system, the stopping or slide movement, the modification of the steel level, the heat currents through the mold walls, the temperature of the liquid metal and the drawing-off speed are measured over the casting time, supplied to a computer and compared with predetermined limit values for an automatic operating mode.

3 Claims, 7 Drawing Sheets a)

b)

c)

METHOD AND SYSTEM FOR OPERATING A HIGH-SPEED CONTINUOUS CASTING PLANT

CROSS REFERENCE TO RELATED APPLICATION

This application is a DIV of 10/009,153 filed on May 10, 2002, now issued as U.S. Pat. No. 6,793,006, which is a 371 of PCT/EP00/05216, filed on Jun. 7, 2000.

BACKGROUND OF THE INVENTION

1. Field of the Invention

The invention relates to a method as well as to a system. Particularly for the operation of high-speed plants for slabs and, in this connection, particularly in combination with rolling mills, it is important to be able to operate the continuous casting plant at a high and controlled speed in a safe way.

This necessity of safety for casting particularly at high casting speeds up to 10 m/min. makes it necessary to carry out control of numerous processing data, which are intermeshed in a complex fashion with one another, by means of automation.

This automation must be reduced with respect to its external operation language to a simple functional language which is easily manageable by the operating personnel.

Moreover, the degree of automation, which in regard to its operating language knows only the selection of casting speed and the control all of the narrow side heat flow at the operator (NO) or drive (ND) side, should provide the possibility of operation by autopilot when certain conditions such as a controlled steel temperature in the distributor a good oxidic purity of the steel a calm meniscus as well as a constant and uniform heat flow of the faces are present.

2. Description of Related Art

The prior art discloses the measuring of the heat flows of all four copper plates of a slab casting mold (DE 4117073) but in this patent document no prior art as a function of the casting speed is disclosed. For example, a speed increase has a minimal effect on the casting mold stress, expressed as $MW/m^2$, and a great effect on the strand shell stress expressed as $MWh/m^2$.

FIG. 1 shows this correlation and illustrates that at high casting speeds, when using casting powder and a certain castings speed of, for example, >4.5 m/min., the casting mold stress remains almost constant and the strand shell stress is greatly reduced. The reason for this is that at high casting speed a constant slag film and thus a constant heat transfer occurs but a residence time of the strand shell within the casting mold decreases proportionally to the casting speed increase. This illustration makes clear that with increasing casting speed the casting mold stress no longer increases and the casting shell stress decreases so that the risk of fracture formation is reduced but also the casting shell becomes thinner and hotter, for example, at the end of the casting mold.

In FIG. 2, the interrelationships are represented between casting slag film, the strand shell temperature, for example, at the exit of the casting mold, strand shell thickness, and shrinkage, casting mold and strand shell stresses or shrinkage, maximum casting mold skin temperature at the meniscus and thus of the casting mold service life in relation to the recrystallization temperature which results in softening of the cold-rolled copper.

U.S. Pat. No. 3,478,808 discloses a method for controlling the parameters of a continuous casting plant forecasting steel. Nominal values of parameters, which have been taken from a previous casting process, are stored; actual values of the parameters are recorded, an adjustment of the actual and nominal values is carried out, and a control of the parameters is performed. The disclosed parameters are inter alia the flow speed, the heat removal rate within the casting mold and the removal speed.

SUMMARY OF THE INVENTION

Based on this, it is an object of the invention to further develop a method and a system for performing the method for a controlled operation of a continuous casting plant for casting slab, in particular, thin slab, with very high casting speeds.

An automation of the continuous casting process based on an "online" data acquisition is made possible which enables in addition to a semi-automation, i.e., the control of the narrow side conicity and the casting speed, also a full automation in the sense of an autopilot operation with consideration and as a function of the steel temperature in the distributor and with the prerequisite of a controlled purity, meniscus, and face heat flow.

This object is solved by the features of the method claim 1, and the device claim with their dependent claims for configuring the invention.

BRIEF DESCRIPTION OF THE DRAWING

The Figures are provided as examples for illustrating the invention and are described in the following. It is shown in.

Figure 1:
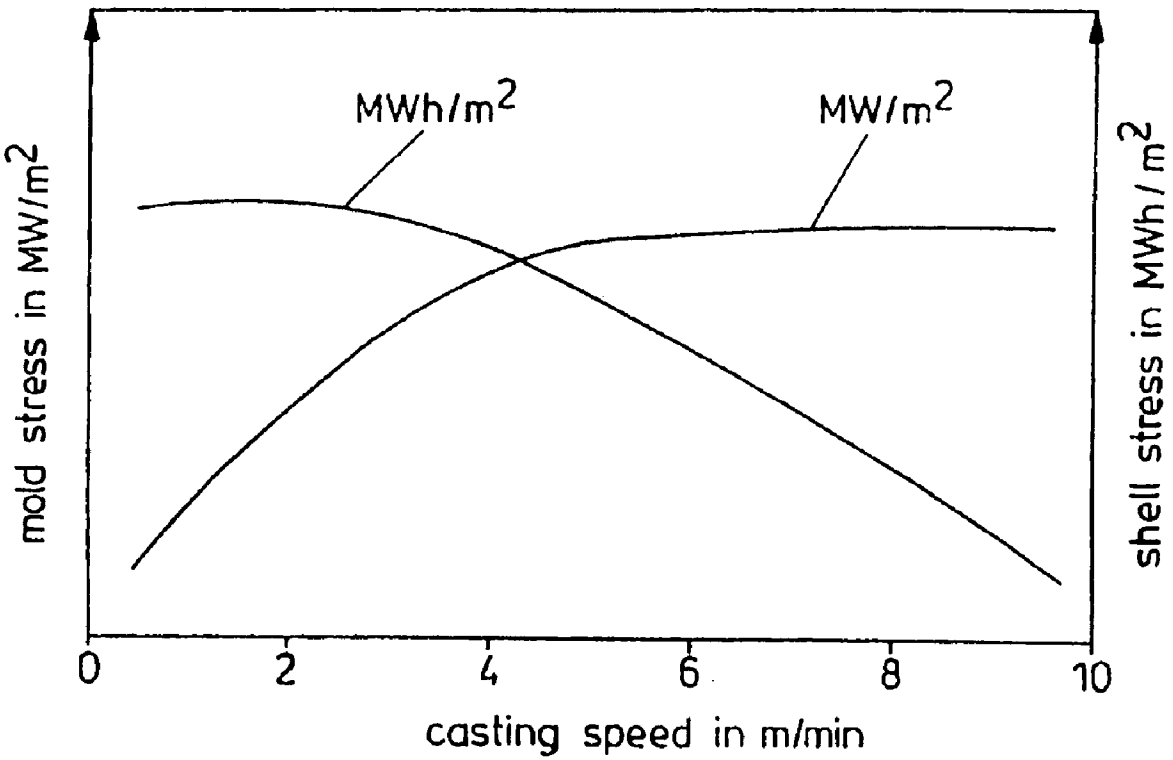
FIG. 1 the casting mold and strand shell stress as a function of the casting speed FIG. 2 the interrelationships between the casting speed and the slag film thickness the strand shell temperature, shrinkage as well as trend shell thickness at the exit of the casting mold, casting mold and strand shell stress as well as shrinkage, temperature stress of the copper plates at the meniscus as well as service life of the copper plates relative to the recrystallization temperature of the cold-rolled copper plate.
Figure 2:
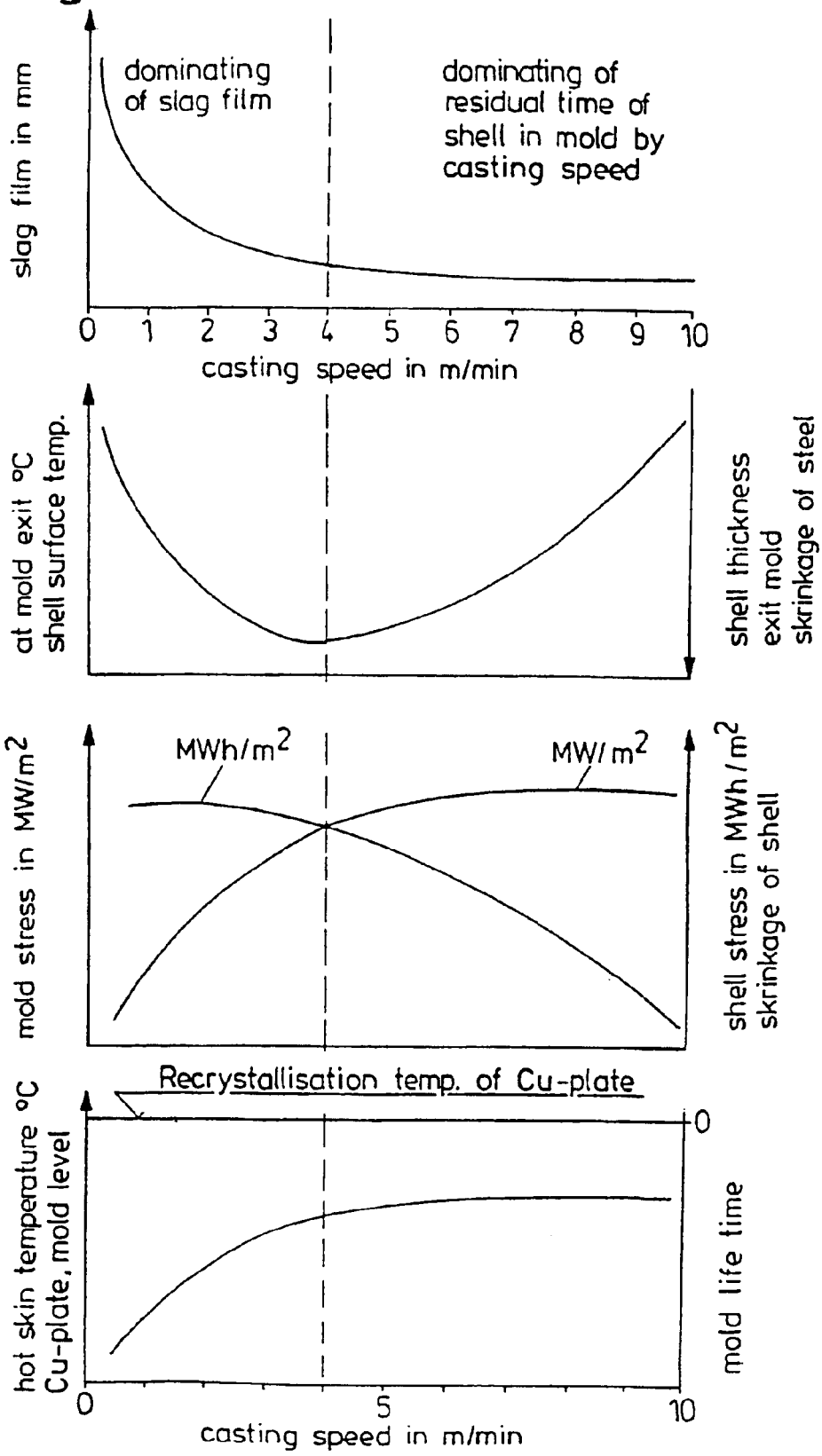

The FIGS. 1 and 2 have already been described in detail as prior art and are provided for a better understanding of the following description which is not to be viewed as being obvious to a person skilled in the art and thus includes an inventive step.

Figure 3:
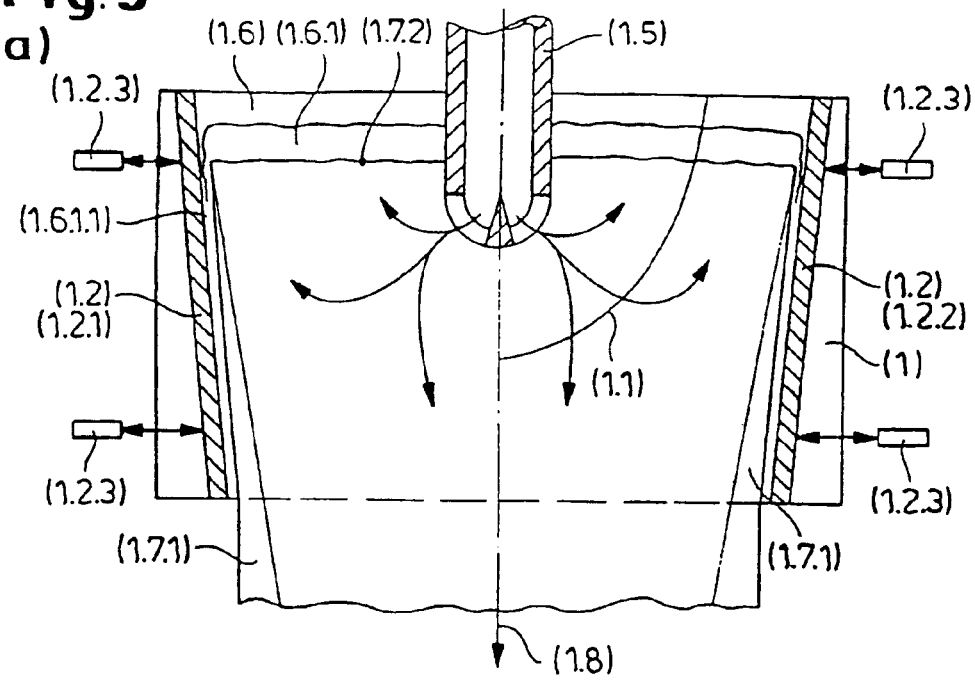
Figure 3:
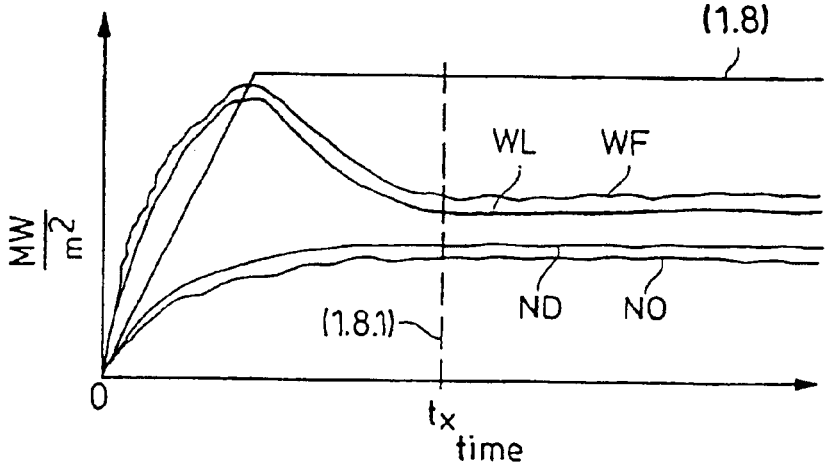
Figure 3:
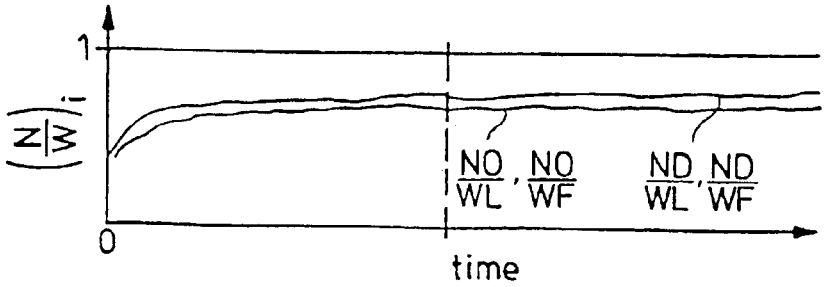

FIG. 3 illustrates a) a slab casting mold (1) with (1.1) and without pouring hopper and in regard to its conicity and adjustable narrow sides (1.2) as well as submerged exit nozzle (SEN)(1.5) and casting powder b) the casting mold stress, expressed as MW/m2 for faces (WL) and (WF) as well as for the narrow sides (ND) and (NO) over the casting time and c) the relationship of the heat flows from the faces to the narrow sides, expressed as NO/WL, NO/WF and ND/WL, NO/WF, which describe the course of the heat flows more simply and facilitate their correction over the conicity adjustment during casting.

Figure 4:
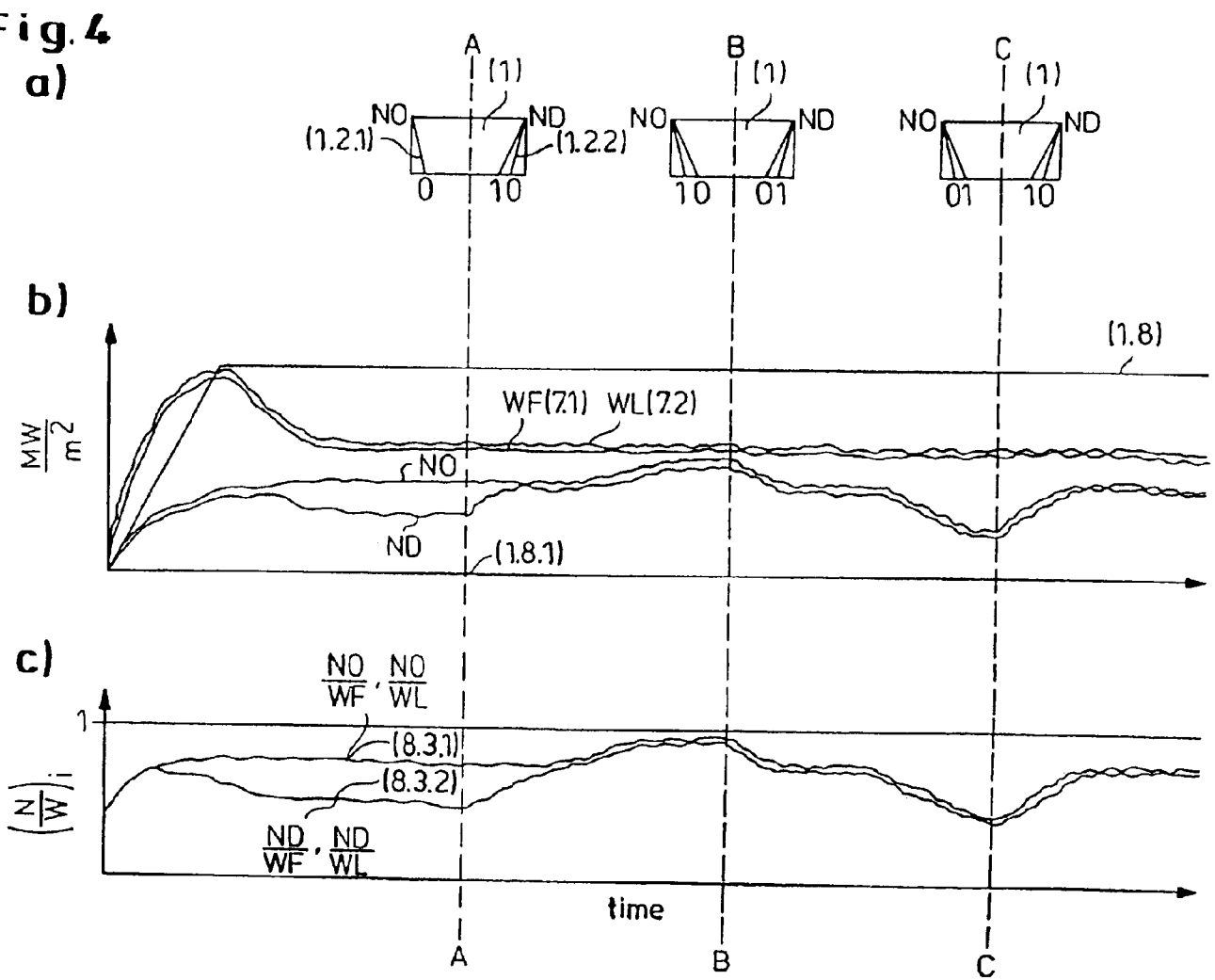

FIG. 4 shows the casting situations A, B, C with the aid of a) the heat flows, expressed as $MW/m^2$ or b) the relationship of the heat flows ND/WF, ND/WL and NO/WF, NO/WL, which experience a correction by adjustment of the narrow sides in their conicity from the position 0 to the position 1.

Figure 5:
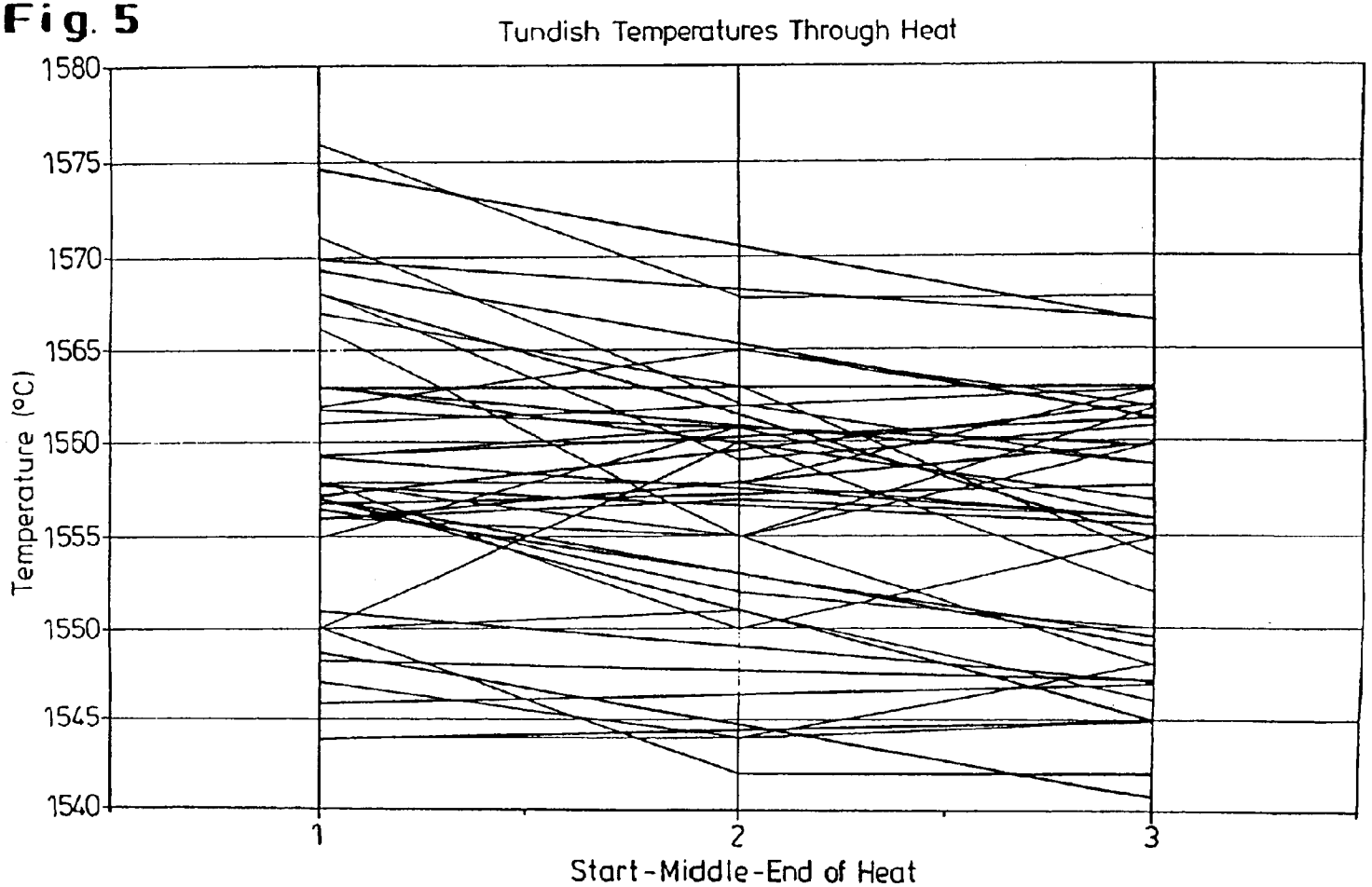

FIG. 5 illustrates the temperature course of molten masses in the distributor over a casting time of one hour.

Figure 6:
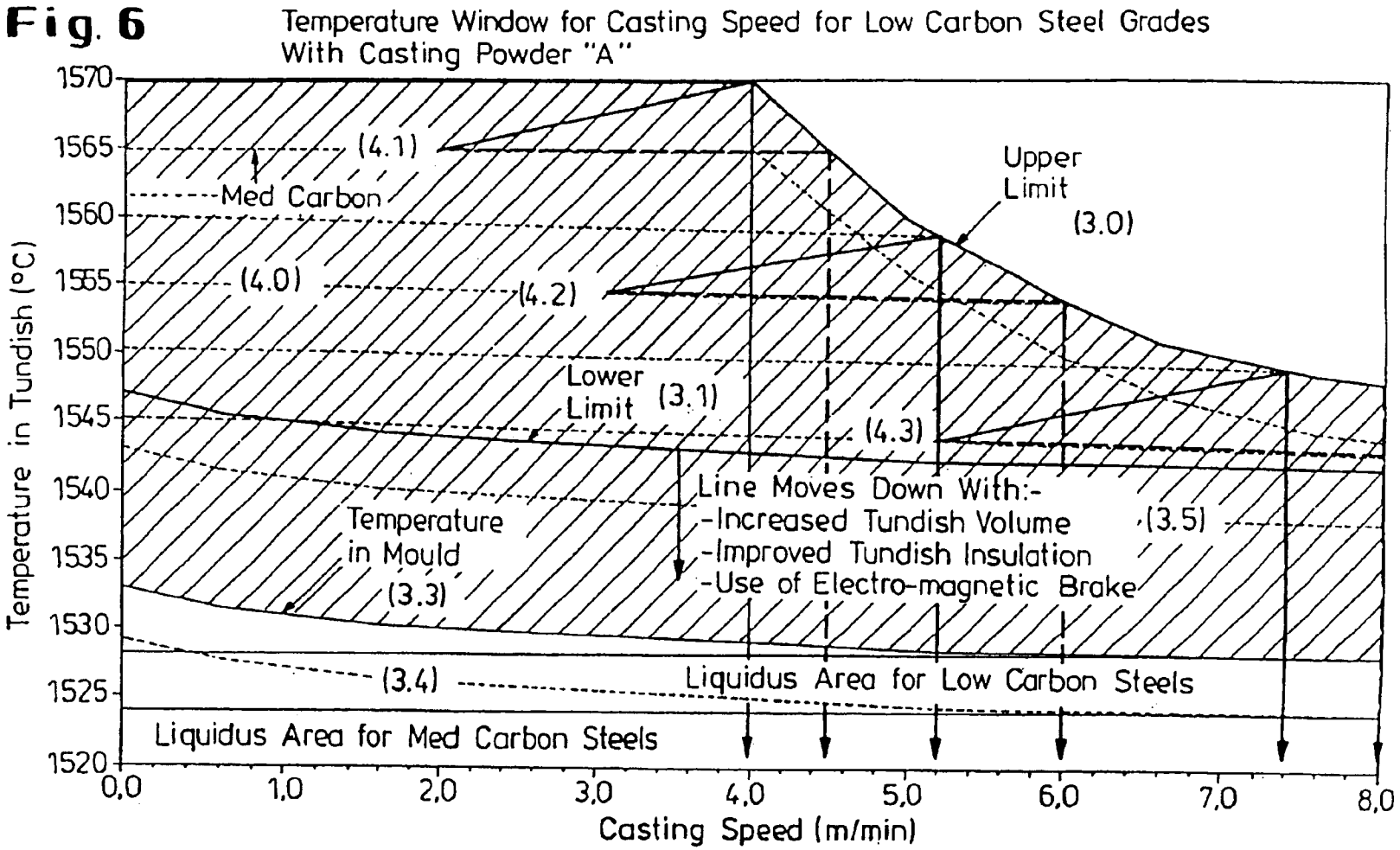

FIG. 6 illustrates the casting, window defined by the steel temperature in the distributor and the casting speed with exemplary temperature courses of different molten masses.

Figure 7:
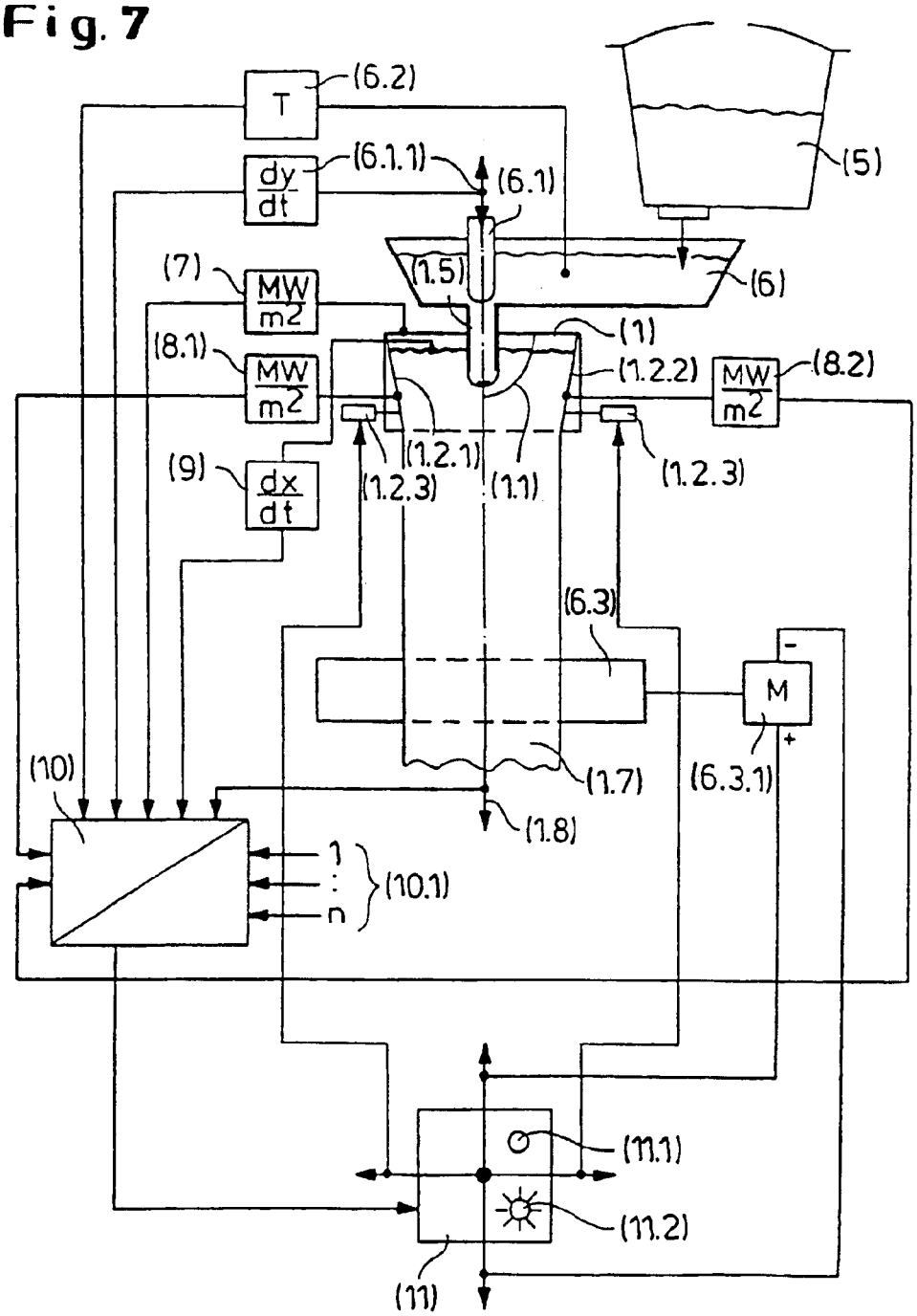

FIG. 7 illustrates the data acquisition and the control circuit in the area of the continuous casting plant with the input of limits for the control and regulation of the narrow side conicities and the maximum casting speed as a function of the steel temperature in the distributor.

DETAILED DESCRIPTION OF THE PREFERRED EMBODIMENTS

FIG. 3 is comprised of the partial Figures a), b), and c).

FIG. 3*a*) illustrates schematically a slab or bloom casting mold (1), comprised of two individual narrow sides (1.2), which are provided at the operating side (1.2.1) (NO) and drive side (1.2.2) (ND) with adjusting cylinders (1.2.3), and two faces (1.3), respectively, the backside (1.3.1) (WF), and the loose side (1.3.2) (WL).

The casting mold (1) furthermore can advantageously be provided with a pouring hopper (1.1). The liquid steel (1.4) is introduced through the submerged exit nozzle (1.5) below the bath level (1.7.2) in the casting mold when using a casting powder (1.6) with formation of casting slag (1.6.1) and a casting slag film between the casting mold (1) and the strand shell (1.7.1), which is provided for lubrication and heat flow control.

FIGS. 3*b*) and *c*) show the specific course of heat flow in $MW/m^2$ of the faces WF, WL (1.3.2) and the narrow sides NO (1.2.1), NO (1.2.2) in the normal, uneventful casting process, wherein the casting time from the beginning to the time tx at which the steel is within temperature equilibrium. The narrow side flows must have over the conicity adjustment of the narrow sides a ratio to the faces of $<0.1$ which must be maintained constant over the casting time.

Different slag films formed across the strand circumference, especially between the faces and the narrow sides, different casting speeds, different steel temperatures, non-uniform flow conditions the left and the right half of the casting mold, a deflection of the slab from the strand center axis in the casting direction can cause deviations in regard to the specific heat dissipation.

These deviations are illustrated in FIG. 4 with the aid of three typical situations A, B and C (FIG. 4) by means of the specific heat flows, expressed as $MW/m^2$ in FIG. 4*b*) and as a heat flow ratio narrow side/faces (N/W) in FIG. 4*c*).

In the situation A, the heat flow of the narrow side deviates at the drive side (ND) (1.2.2) from that of the narrow side at the thickness side (NO) (1.2.1) by a heat flow that is too small. With a greater adjustment of the conicity at the narrow side from position 0 to position 1, the heat flow is adjusted to that of the narrow side (NO).

In the situation B, the heat flows of both narrow sides are too great in comparison to the faces. By reducing the conicity adjustment of both narrow sides from the position 0 to the position 1, the heat flows are brought into the correct ratio relative to the faces.

In the situation C, the heat flows of the narrow sides are too small and can be adjusted to the correct value relative to the faces by a simultaneous enlargement of the narrow side conicity from the position 0 to the position 1.

FIG. 5 represents the temperature course of numerous molten masses over a time period of approximately 1 hour in the distributor. It can be seen that, for example, in these ladles with a molten mass contents of approximately 180 t the steel temperature drops by approximately 5° C./hour. This drop of the steel temperature in the distributor can be kept relatively small and depends substantially on the residence time of the steel in the distributor, i.e., the casting output and the insulation of the distributor.

The absolute temperature with which the steel flows into the distributor is predetermined by the continuous casting operation, is adjusted by the steel mill and depends on, for example, ladle transport times, ladle age, and ladle lining, which result often in deviations from the nominal temperature because of an uncontrolled operation process.

FIG. 6 represents the casting window defined by the steel temperature in the distributor and the maximum possible casting speed.

The casting window (4) is defined by an upper (3.0) and a lower (3.1) temperature limit. Moreover, in addition to the steel temperature in the casting mold (3.3), the area of the liquidus temperature (3.4) of, for example, low-carbon steel qualities, is illustrated. The steel temperature in the casting mold increases for a constant steel temperature in the distributor with greater distributor volume, improved distributor insulation, use of magneto-electro brake in the casting mold.

The FIG. 6 represents three molten masses with different distributor temperatures and thus different maximum possible casting speeds, but, for example, identical temperature loss of 5° C./hour.

In detail, these three situation in the casting window (4) are as follows.

In the case (4.1), the steel temperature at the start of casting is 1,570° C. and makes possible a maximum casting speed (1.8) of 4.0 m/min., and after 1 hour ca sting time at the end of the ladle casting time the steel temperature of 1,565° C. allows for a maximum casting speed of 4.5 m/min.

In the case (4.2), the steel temperature in the distributor at the start of casting of the melt is 1,560° C. and at the end of casting 1,555° C. which makes possible a maximum casting speed of 5.0 m/min. and of 5.85 m/min. at the end of casting.

In the case (4.3), the temperature is 1,550° C. makes possible a casting speed of 7.2 m/min. and at the end of casting, with a temperature of 1,545° C., a casting speed of >8 m/min. The speed of a maximum of 8 m/min. can be adjusted when reaching a temperature of approximately 1,548° C.

FIG. 7 illustrates the configuration of a semi-automation or a full automation/autopilot for casting in a high speed plant.

The device is comprised of a steel ladle (5), a distributor (6) with a stopper or slide closure (6.1) as well as a discontinuous or continuous temperature measurement in the distributor, a continuous casting plant with oscillating casting mold (1) and adjustable narrow sides (12) as well as removal rollers (6.3) which are driven by a motor (6.3.1) and which remove the strand at a controlled casting speed (1.8).

The following data acquisition is required for a full automation/autopilot:

temperature measurement of the steel in the distributor (6.2) in ° C.;

stopper movement or slide movement (6.1.1) in dy/dt;

heat flow measurement of the faces (7) in $MW/m^2$;

heat flow measurement of the narrow sides (8) in $MW/m^2$;

stopper movement movement of the meniscus (9) in dx/dt; and actual casting speed (1.8) in m/min.

These data are compared in an online computer (10) with the limits.

With preconditions such as a stopper movement of dy/dt of +0, i.e., a "clean steel" which does not lead to a significant oxidic deposition within the SEN as well as to no stopper and SEN erosion, a constant heat flow, within the faces at constant casting speed with a tolerance of a maximum of 0.1 $MW/m^2$ over the casting time and relative to one another, a meniscus movement of a maximum of ±5 mm for a casting time of 60 seconds, a heat flow ratio of the narrow sides to the faces of >0.9 and <0.4 the system interface (11) in the form of a "joystick" having the four functions +/− casting speed and +/− taper for the individual narrow sides and representing a semi-automation, can be switched to full automation or the status of autopilot in an operatively safe and thus breakout-free way (<0.5 percent).

The full automation corrects with the casting operation the conicity adjustments of each individual narrow side based on the heat flow ratios between the narrow sides and the faces outside of a narrow side/faces ratio of, for example, $$0.8 > \frac{N}{W} > 0.5.$$

and automatically adjusts the maximum possible casting speed which is possible as a result of the steel temperature in the distributor and the provided equation.

The invention makes possible a reproducible operation of the continuous casting plant with maximum possible productivity and controlled strand quality while avoiding breakout.

LIST OF REFERENCE NUMERALS (1) slab casting mold with oscillation
(1.1) hopper
(1.2) narrow sides of casting mold
(1.2.1) narrow side of the operator side (NO)
(1.2.2) narrow side of the drive side (ND)
(1.2.3) adjusting cylinder
(1.3) faces
(1.3.1) face, fixed, or backside, WF
(1.3.2) face loose side or backside, WL
(1.4) liquid steel
(1.5) submerged entry nozzle, SEN
(1.6) casting powder
(1.6.1.1) casting slag film between casting mold and strand shell
(1.7) strand
(1.7.1) strand shell
(1.7.2) meniscus
(1.8) casting speed, $V_c$
(1.8.1) casting time $t_x$, after which the steel temperature is in equilibrium with the distributor
(3) upper temperature limit
(3.1) lower temperature limit
(3.3) steel temperature in the casting mold
(3.4) area of the liquidus temperature of "low carbon" steel qualities
(3.5) causes of an increase of the steel temperature in the casting mold at controlled temperature of the steel in the distributor inlet
(4) casting window with three molten masses of different temperatures in the distributor and identical temperature loss of 5° C./hour in the casting window of steel temperature/casting speed
(4.1) situation 1 with a molten mass which results in a steel temperature in the distributor of 1,570° C. at the start of casting and 1,565° C. at the end of casting and allows for a casting speed of 4.0 and a maximum of 4.5 m/min.
(4.2) situation 2 with a molten mass which results in a steel temperature in the distributor of 1,560° C. at the beginning of casting and 1,560° C. at the end of casting and allows a casting speed of 5.0 and a maximum of 5.85 m/min
(4.3) situation 3 with the molten mass results in a steel temperature in the distributor of 1,500° C. at the start of casting and 1,545° C. at the end of casting and allows a casting speed of 7.0 and >8.0 m/min
(5) steel ladle
(6) distributor
(6.1) stopper or slide closure
(6.1.1) stopper or slide movement
(6.2) discontinuous or continuous temperature measurement of the steel in the distributor
(6.3) driven removal rollers
(6.3.1) drive motor
(7) heat flow measurement in $MW/m^2$ of the faces
(7.1) faces of the backside, fixed side WF
(7.2) faces of the loose side, WL
(8) heat flow measurement in MW/m2 of the narrow sides
(8.1) heat flow measurement of the operator side (NO)
(8.2) heat flow measurement of the drive side (ND)
(8.3) heat flow ratio narrow sides/faces
(8.3.1) heat flow ratio operator-narrow side/faces $$\frac{(NO,\ NO)}{(WL\ \ WF)}$$

(8.3.2) heat flow ratio drive narrow side/faces $$\frac{(ND,\ NO)}{(WL\ \ WF)}$$

(9) meniscus movement dx/dt
(10) online computer
(10.1) limits
(11) system interface "joystick"
(11.1) full automation/autopilot status
(11.2) alarm for taking over in semi-automation

What is claimed is:

1. System provided in a high-speed continuous casting plant for casting a metallic strand (1.7) in particular a slab, with casting speeds of maximally .10 m/min., the system comprising an oscillating casting mold (1) which comprises oppositely positioned casting mold narrows sides (1.2.1, 1.2.2) and faces (1.3.1, 1.3.2), in particular comprised of copper plates, which can be controlled during casting by means of adjusting cylinders (1.2.3) with regard to their conicity, wherein molten mass flows via a submerged exit nozzle (1.5) or a nozzle from a distributor (6) into the casting mold (1) and the distributor (6) has a movable stopper (6.1) or a slide closure for regulating the in flowing molten mass quantity, optionally employing casting powder (1.6), comprising means for measuring the meniscus movement (9), a continuous or discontinuous measuring device for measuring the melting temperature in the distributor (6.2), comprising means for measuring the actual casting speed (1.8) of the strand, in particular, the slab, as well as a computing unit (10) for determining the changes of the casting process over a predetermined casting time interval as well as for comparing the changes with predetermined limits (10.1), further comprising means for measuring the stopper or slide closure movement (6.1.1), means for measuring the face heat flow (7) of the fixed side and the loose side, means for measuring the narrow side heat flows (8) of the operating side and the drive side, means (1.2.3) for changing the angular position of the conically arranged two narrow sides of the casting mold as well as means for changing the casting speed, wherein the means for changing the angular position of the narrow sides as well as the means for changing the casting speed can be automatically controlled as a function of the result of the computing unit (10) or can be controlled semi-automatically.

2. System according to claim 1, comprising alarm means (11.2) which are activated upon surpassing the predetermined limits based on the computed changes of the measured values and means for switching back the automatic operation to a semi-automated operation.

3. System according to claim 1, wherein a joystick (11) is provided as an operating means for semi-automatic control of the casting speed and/or the angular position of at least one of the two casting mold narrow sides (12, 13).

* * * * *